US005570428A

United States Patent [19]

Madaffari et al.

[11] Patent Number: 5,570,428

[45] Date of Patent: Oct. 29, 1996

[54] TRANSDUCER ASSEMBLY

[75] Inventors: Peter L. Madaffari, Camden; James S. Collins, Lincolnville, both of Me.

[73] Assignee: Tibbetts Industries, Inc., Camden, Me.

[21] Appl. No.: 447,725

[22] Filed: May 23, 1995

Related U.S. Application Data

[63] Continuation of Ser. No. 313,371, Sep. 27, 1994, abandoned.

[51] Int. Cl.[6] ..... H04R 25/00

[52] U.S. Cl. ..... 381/191; 381/174; 381/188

[58] Field of Search ..... 381/191, 174, 381/69, 116, 113, 188; 367/170, 181; 29/25.41

[56] References Cited

U.S. PATENT DOCUMENTS

| | | | |
|---|---|---|---|
| 3,118,022 | 1/1964 | Sessler et al. | 179/111 |
| 3,816,671 | 6/1974 | Fraim et al. | 179/111 E |
| 4,331,840 | 5/1982 | Murphy et al. | 179/111 |
| 4,730,283 | 3/1988 | Carlson et al. | 367/181 |
| 4,764,690 | 8/1988 | Murphy et al. | 307/400 |
| 5,101,543 | 4/1992 | Cote et al. | 381/191 |
| 5,193,116 | 3/1993 | Mostardo | 381/169 |
| 5,335,286 | 8/1994 | Carlson et al. | 381/191 |

*Primary Examiner*—Curtis Kuntz
*Assistant Examiner*—Huyen D. Le
*Attorney, Agent, or Firm*—Lahive & Cockfield

[57] ABSTRACT

A housing and diaphragm assembly for use in an acoustic transducer comprises a performed face plate having a ring shaped ridge for mounting the diaphragm. The housing includes a tubular sleeve having one end received over the ridge and secured to the face plate. Additional elements comprising an electret transducer are mounted with the diaphragm on the ridge internally of the housing.

3 Claims, 2 Drawing Sheets

TRANSDUCER ASSEMBLY

This application is a continuation of Ser. No. 08/313,371, filed Sep. 27, 1994, now abandoned.

BRIEF SUMMARY OF THE INVENTION

This invention relates generally to electro-acoustic transducers, and in particular to assemblies comprising a diaphragm element.

In applications such as hearing aids, transducers are required Br conversion between acoustic and electric energy. Hearing aids include a microphone which converts acoustic energy to electric energy and a receiver which converts electric energy to acoustic energy. Both forms of transducers use a diaphragm. The form of the diaphragm will often control the frequency response of the transducer, and it is necessary that the diaphragm be rugged enough that the properties of the diaphragm are not altered by the environment, by time, or by abuse. To this end the diaphragm is often enclosed by a metal housing in the form of a cup. In general, the diaphragm divides the volume of the housing into two chambers, one of which is essentially sealed from the environment by the diaphragm and the other of which communicates with the exterior of the housing by an aperture therein. As it is the motion of the diaphragm that controls the transduction, it is intended that the diaphragm move substantially as a single piece.

To ensure this overall uniform motion, one approach has been to make the diaphragm form a sheet of metal, thus providing a rugged structure. This also has a useful secondary effect in that the diaphragm is ideally suited for use as one of the plates of a condenser microphone. However, the use of a metal diaphragm may have disadvantages as well. The diaphragm may be too rigid, thus reducing its output signal. Also, the diaphragm may be massive enough to cause unwanted resonance within the desired acoustic pass band of the transducer. In addition, there may be an unwanted "accelerometer" effect by which the mass and compliance of the housing may cause motion of the diaphragm relative to the housing when the housing is shaken or accelerated for any reason.

One variant of the condenser microphone is the electret condenser microphone. As opposed to conventional condenser microphones which use an external voltage source to provide the necessary potential for bias, the electret condenser microphone is self-biased. As is well known in the an, an electret film, once charged, retains the charge for extended periods. This film can be made very thin, and when coated on one side by metal, can be used as both the biasing means and the diaphragm Br the condenser microphone. However, combining these functions in a single film also has disadvantages. A preferred material for the diaphragm is a condensation product of ethylene glycol and terepthalic acid sold by dupont under the name Mylar.

On the other hand, a preferred electret material is a tetrafluoroethylene polymer sold by dupont under the name Teflon. While this latter material forms an effective biasing means when laminated to the fixed metal backplate, it cannot be fabricated in thicknesses as small as Mylar. On the other hand, when Mylar is metalized it can be used for the moving plate of the condenser microphone. It is desirable to fabricate this material in small thickness to improve the diaphragm compliance while reducing its accelerometer effects.

Current practice in the fabrication of transducers is to form a support ring, fasten the diaphragm film in place on the ring, and then contain the fragile assembly in a housing made from a formed cup. A Mylar diaphragm may be formed into various shapes including that of an annular ring surrounding a at central portion. This annulus serves the function of stress relief and improves the linearity of the deflection with high sound pressure levels. It is possible to fix such a diaphragm to the housing by an in-situ cementing operation. Because of the annulus, stresses caused by the cementing operation do not affect the performance of the central portion.

However, current fabrication techniques for both the ring and the drawn cup have reached the lower practical limits of size, and the accelerometer effect has continued to be a problem especially as a cause of feedback in hearing aid applications. Ever thinner films of diaphragm material have been tried, but the formed diaphragm approach reaches a lower limit with respect to diaphragm stability under exposure to an electrostatic field. Efforts to make formed, unsupported films of very thin material have not been commercially successful.

Efforts have turned to tensioned films as diaphragms. Such diaphragms are formed by stretching a film over a support so that even tensioning is achieved. Tensioned films have coexisted with formed films, but compliance variations with heat and/or humidity have reduced their effectiveness. By matching the coefficient of thermal expansion of the support to the film, the temperature problem has been reduced. However, the humidity or hygroscopic coefficient of expansion of the film cannot be effectively matched to a suitable support material. Fortunately, for a given compliance, the thinner the film the lower the change in compliance with a given change in humidity as a result of the higher relative strain in the film for a given stress or applied tension. It has been possible to fabricate a film that is thin enough to benefit from this effect, but such films under high tension are extremely fragile. It is also important that the support ring is not deformed, even though the film is undamaged, because it is the diaphragm support which maintains the tensioning after diaphragm construction.

In transducers fabricated according to current practice, the support ring, although necessary for stability, does not contribute to the functioning of the diaphragm, that is, it produces no motion in response to variations in sound pressure.

The area closest to the support is virtually motionless also, with the compliance increasing with distance from the diaphragm edge to its center. As the diaphragm becomes smaller, the average distance tom the support becomes progressively smaller, and consequently the average displacement decreases also.

In addition, as smaller diaphragms are employed, there is a practical limit to the scaling of the support, below which the support itself is too fragile for handling. Once the support has been cemented to the housing, the diaphragm can be more easily handled.

With a view to overcoming the above problems in fabrication and performance of transducers of small size, a principal feature of this invention resides in a novel assembly having a housing comprising a tubular sleeve member closed at one end by a face plate having a ring shaped ridge surrounding a central portion thereof. The ridge is formed with a mounting surface thereon lying in a plane spaced from and generally parallel to the central portion and the diaphragm is secured to this surface. The face plate and diaphragm form a subassembly, to which the tubular sleeve is later attached by receiving one end over the ridge and securing it to the face plate. By this means, the support for the diaphragm can be made very rigid, rugged and easily handled, yet requires minimal material and allows a smaller device to be built.

DRAWINGS

DETAILED DESCRIPTION

Figure 1:
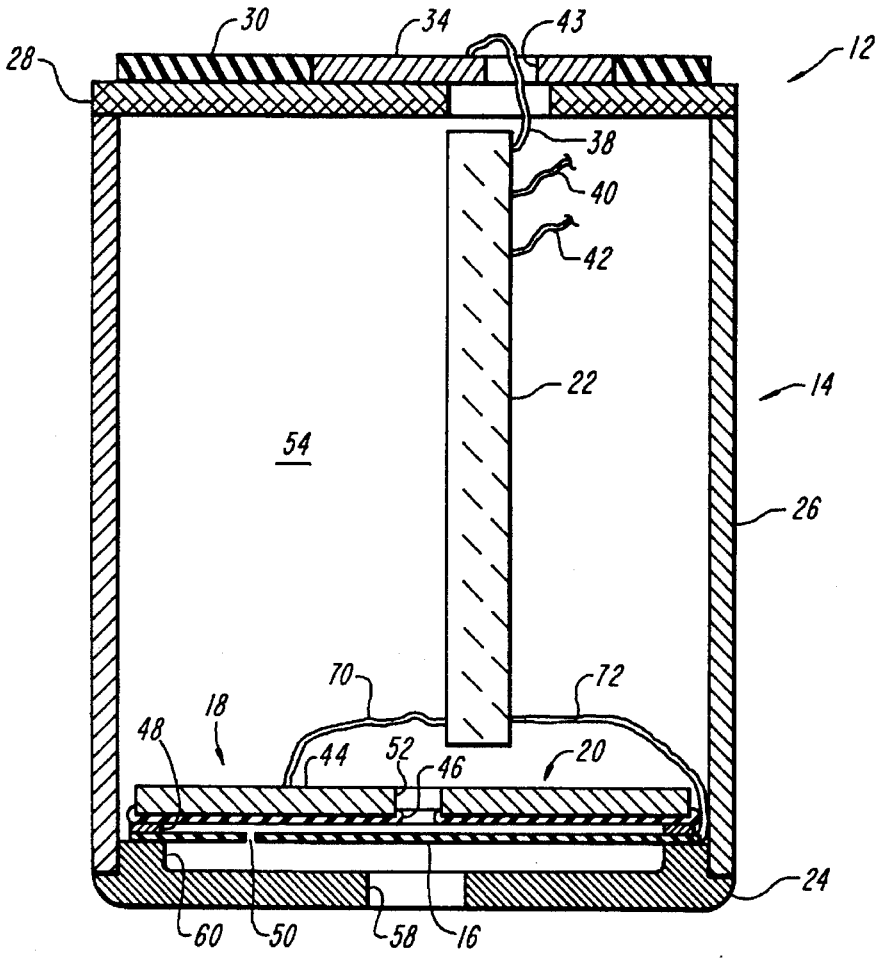
FIG. 1 is an elevation in section of a presently preferred embodiment of the invention.
Figure 2:
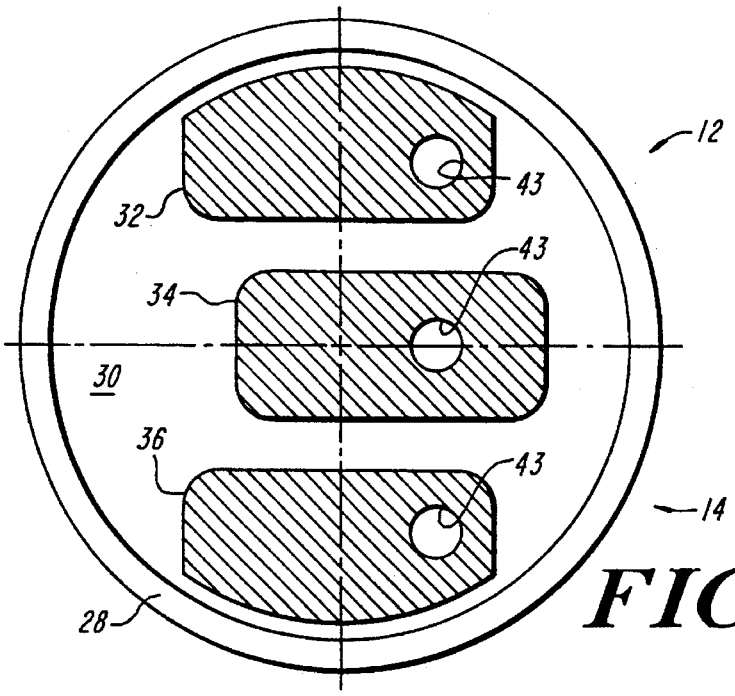
FIG. 2 is a top view in plan of the embodiment of FIG. 1.
Figure 4:
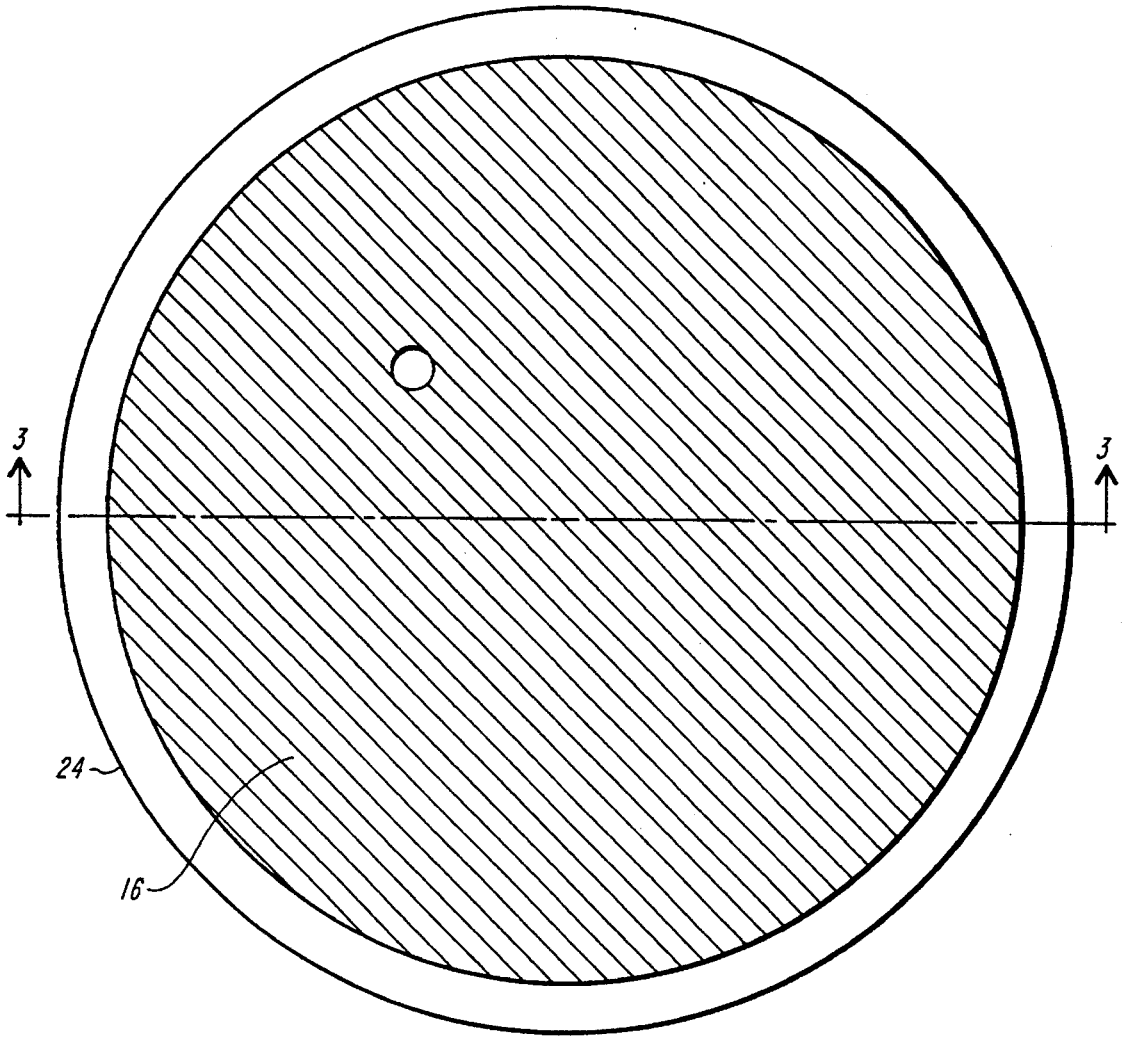
FIG. 4 is a top view in plan corresponding to FIG. 3.

Referring to the drawings, the transducer assembly is designated generally at 12 and comprises a housing 14, a diaphragm 16, transducer means 18 combining with the diaphragm to form an electret transducer 20, and an amplifier 22 mounted in any suitable manner within the housing 14.

The housing 14 comprises a substantially rigid metal face plate 24, a tubular metal sleeve 26, a metal cover plate 28 and a terminal board 30 of insulating material attached by adhesive to the cover plate.

In general accordance with conventional practice, the terminal board 30 has three metal terminal pads 32, 34 and 36 mounted thereon. The pads are mounted within apertures of corresponding shape in the terminal board 30. Leads 38, 40 and 42 extend through round apertures 43 in the terminal board and pads, and are soldered externally to the pads.

Figure 3:
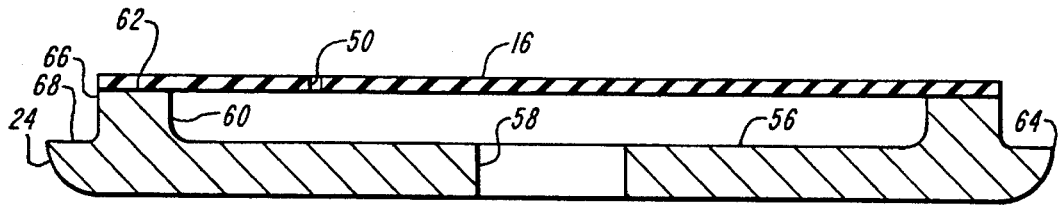
FIG. 3 is an enlarged elevation in section of the diaphragm and face plate subassembly of the embodiment of FIG. 1.

The transducer comprises a rigid metal backplate 44, an electret film 46 preferably of Teflon bonded to the backplate and suitably polarized, and the diaphragm 16, preferably of Mylar, which is metalized on the upper surface as viewed in FIGS. 1 and 3. The diaphragm is spaced from the electret film 46 by a spacer ring 48 of insulating material. The diaphragm is perforated to provide a very small aperture 50, and the backplate and electret film are formed with a central aperture 52, whereby the apertures 50 and 52 provide communication between the interior space 54 of the housing and the space external to the device for equalizing the static pressures in these spaces.

The component parts of the electret transducer 20 can be modified in shape and in details of their construction and assembly in accordance with presently known techniques, in any manner consistent with the following description.

The face plate 24 is preferably fabricated as a screw machine part. As viewed in diametric cross section as in FIGS. 1 and 3, it has a flat central portion 56 of uniform thickness with opposed, generally parallel faces and with a central opening 58, and an annular ridge 60 surrounding the central portion and having an annular mounting surface 62 thereon extending in a plane spaced from and generally parallel to the central portion 56. In this preferred embodiment the ridge 60 is spaced inwardly of the peripheral edge 64 of the face plate, thus forming an annular, outwardly facing surface 66 perpendicular to the face plate and an annular end surface 68.

Fabrication is as follows. A sheet of diaphragm material is placed upon and secured to the mounting surface 62. Thus the face plate serves both as the end element of the housing itself, and as the diaphragm support. With the diaphragm 16 secured in position as shown in FIGS. 1 and 3, the spacer ring 48 is placed over and secured to the diaphragm, and the backplate 44 with the electret film 46 attached thereto is placed over and secured to the spacer ring.

A wire 70 is connected between the backplate 44 and the amplifier 22. A wire 72 is connected between the metal film on the diaphragm 16 and the amplifier 22.

The sleeve 26 is then received over the ridge 60 of the face plate and against the surface 68, and the sleeve and face plate are secured together by adhesive.

With the leads 38, 40 and 42 extended through the respective round apertures 43 in the terminal pads, the cover plate 28 with the circuit board 30 in place thereon is secured to the end of the sleeve 26. The leads 38, 40 and 42 are then soldered to the terminal pads 32, 34 and 36 to complete the assembly.

In the preferred embodiment the face plate 24 and the ridge 60 are each circular and the sleeve 26 is formed as a right circular cylinder. Thus the sleeve can be formed by simply manufacturing a long cylindrical extrusion and dividing it into pieces of appropriate lengths for the transducers. However, it will be apparent from the foregoing description that the invention is not limited to a circular the plate and a right cylindrical sleeve, and other shapes may be employed where a different geometry is desired. For face plates in other shapes, a ridge corresponding to the ridge 60 can be formed in a similar shape or in some other annular shape to support the diaphragm 16 in spaced relation to the central portion 56 of the face plate. In each case, tubing of a shape corresponding to that of the face plate is received over the ridge 60 with an end portion against the end surface 68 and in position to be secured to the face plate.

As used in this application, the word "annular" is intended to mean having the form of a ring without limitation to a ring of circular shape. For example, the shape may be oval, rectangular, square or some other shape. Similarly, "tubular" is not intended to be limited to a right cylindrical configuration, and includes cross sections that may be of, for example, oval, rectangular, square or other outline that is closed upon itself.

We claim:

1. A transducer assembly having, in combination, a subassembly comprising a faceplate having a pair of opposed major surfaces bounded by a lateral edge and a ring shaped ridge spaced inwardly of said edge and surrounding a central portion of the face plate, said ridge extending from one of said surfaces in a direction normal thereto and terminating in an extremity of the face plate in said direction formed as a closed loop mounting surface lying in a plane spaced from and generally parallel to said central portion, said central portion having an aperture therethrough, said subassembly further comprising a flexible diaphragm having a metalized surface and extending over and secured at its periphery to said mounting surface, transducer means secured to the periphery of the diaphragm and comprising a backplate, an electret film on the backplate facing the diaphragm and spacer means between the diaphragm and said film, and a tubular sleeve having one end extending over and laterally externally to said ridge and being secured to the face plate.

2. A transducer assembly according to claim 1, in which the ridge and face plate comprise a unitary body.

3. A transducer according to claim 1, in which the transducer means include an amplifier, leads extending from the amplifier to said backplate and metalized surface, and leads extending from the amplifier to terminals on an external surface of the assembly.

* * * * *

UNITED STATES PATENT AND TRADEMARK OFFICE

CERTIFICATE OF CORRECTION

PATENT NO. : 5,570,428
DATED : October 29, 1996
INVENTOR(S) : Peter L. Madaffari and James S. Collins it is certified that error appears in the above-indentified patent and that said Letters Patent is hereby corrected as shown below:

Column 1, line 12, cancel "Br" and substitute --for--; line 30, cancel "form" and substitute --from--; line 47, cancel "an" and substitute --art--; line 51, cancel "Br" and substitute --for--; line 55, cancel "dupont" and substitute --duPont--; line 57, cancel "dupont" and substitute --duPont--.

Column 2, line 48, cancel "tom" and substitute --from--.

Column 4, line 19, cancel "the" (second occurrence) and substitute --face--.

Signed and Sealed this

Twenty-first Day of January, 1997

*Attest:*

Bruce Lehman

BRUCE LEHMAN

*Attesting Officer*

*Commissioner of Patents and Trademarks*